United States Patent [19]

Kemmer

[11] Patent Number: 4,823,485

[45] Date of Patent: Apr. 25, 1989

[54] SYSTEM FOR SECURING A FOOT OR INNER SHOE IN THE TOE OR INSTEP REGION OF A SHELL

[75] Inventor: Karl Kemmer, Graz, Austria

[73] Assignee: Koflach Sport Gesellschaft GmbH & Co. KG, Voecklabruck, Austria

[21] Appl. No.: 127,897

[22] PCT Filed: Mar. 20, 1987

[86] PCT No.: PCT/AT87/00019

§ 371 Date: Nov. 19, 1987

§ 102(e) Date: Nov. 19, 1987

[87] PCT Pub. No.: WO87/05474

PCT Pub. Date: Sep. 24, 1987

[30] Foreign Application Priority Data

Mar. 21, 1986 [AT] Austria ..... 764/86

[51] Int. Cl.[4] ..... A43B 5/04; A43B 7/14

[52] U.S. Cl. ..... 36/119; 36/58.5; 36/88

[58] Field of Search ..... 36/117–121, 36/58.5, 88, 93; 128/611

[56] References Cited

U.S. PATENT DOCUMENTS

| | | | |
|---|---|---|---|
| 4,192,087 | 3/1980 | Salomon | 36/119 |
| 4,253,251 | 3/1981 | Salomon | 36/119 |
| 4,583,306 | 4/1986 | Paris | 36/119 |
| 4,590,691 | 5/1986 | Olivieri | 36/119 |
| 4,638,578 | 1/1987 | Eiteljorg II | 36/119 |
| 4,670,999 | 6/1987 | Olivieri | 36/119 |
| 4,719,670 | 1/1988 | Kurt | 36/119 X |

FOREIGN PATENT DOCUMENTS

| | | | |
|---|---|---|---|
| 3201702 | 9/1982 | Fed. Rep. of Germany | 36/119 |
| 2576192 | 7/1986 | France | 36/117 |

*Primary Examiner*—James Kee Chi

*Attorney, Agent, or Firm*—Peter E. Rosden

[57] ABSTRACT

A system for securing a foot or inner shoe (4) in the toe or instep region of a shell (3), in particular a ski-boot (1) with a hinged rear part (2), comprises plate-shaped parts (6) which overlap the instep or inner shoe (4) and can be adjusted in relation to the shell (3). Two plate-shaped parts (6) are connected in an articulated manner to the outside of the sole on both sides of the longitudinal central plane of the boot (1) and overlap one another in the instep region. Preferably, the plate-shaped parts (6) are overlapped at least partially by tension elements (11), in particular clampable cables or strips, whereby preferably a clamping element (17) of a clamping device engages with the tension elements (11).

19 Claims, 1 Drawing Sheet

SYSTEM FOR SECURING A FOOT OR INNER SHOE IN THE TOE OR INSTEP REGION OF A SHELL

Figure 1:
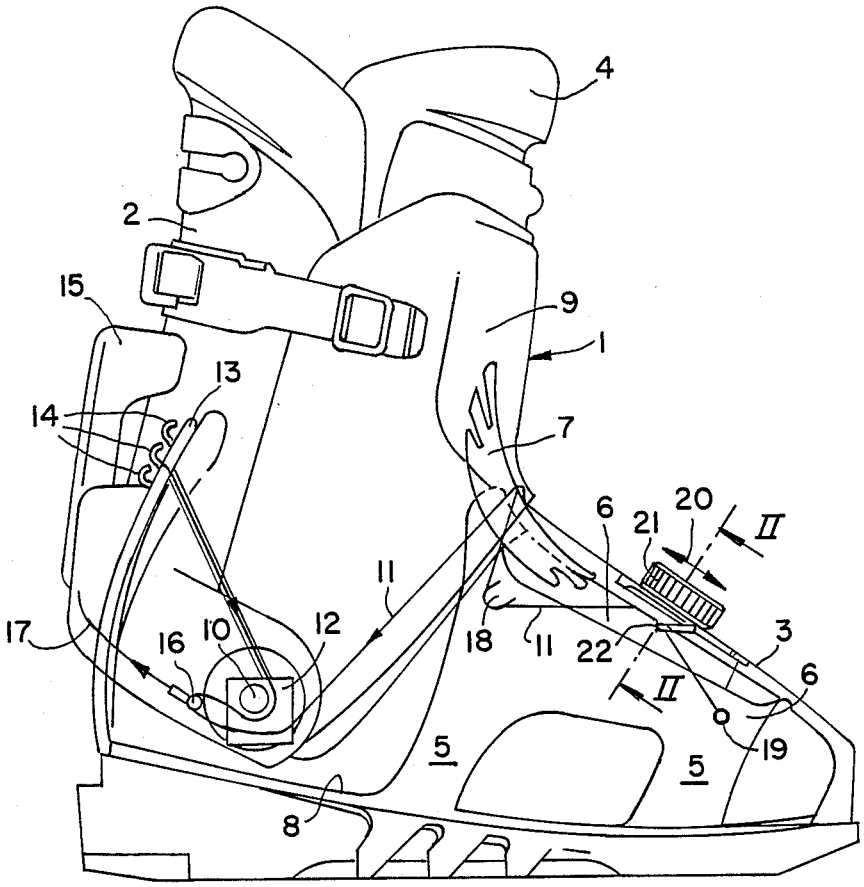

The invention relates to a system for securing a foot or inner shoe in the toe or instep region of a shell, particularly of a ski boot with a tiltable rear part, having plate-shaped parts that overlap the instep or the inner shoe and are adjustable relative to the shell.

Based on CH-PS No. 590 625, it is known to arrange, in the toe or instep area of a shoe, a vertically adjustable instep plate that, by means of adjusting elements, such as adjusting screws, can be pressed against a foot or an inner shoe from above. A good distribution of pressure without annoying pressure points will be achieved in this case if a sufficiently rigid instep plate is used. However, relatively rigid instep plates of this type adapt themselves inadequately to the irregular shape of the instep of a foot and, as a rule, only result in the feeling of a better fit without significantly improving the hold. Furthermore, a lateral hold of the foot in the shoe cannot be guaranteed through use of instep plates which are adjustable only from above. CH-PS No. 614 357 discloses a system of the aforementioned type in which straps that were laterally sewn onto the shoe or shell are tightened with respect to one another by means of an adjusting element. If undesirable pressure points are to be avoided in this type of construction, the straps must be relatively flexible, and, concomitantly, the lateral hold will be improved. However, if, in addition, the foot is to be held against the sole, other undesirable pressure points may still easily occur by using this same type of construction. Instep plates on which pressure is exerted by means of a cable pull are also described, for example, in AT-PS No. 373 478. Such cables pull the foot into the heel area and in this way may improve the overall hold of the foot in the shoe. This type of construction provides adjustability and adaptability, at best, only over a relatively narrowly defined area and inadequately accommodates irregular foot shapes.

A main object of this invention is to provide a system of the aforementioned type by means of which the instep region can be secured precisely over a large length without any bothersome pressure points even in the case of varying foot shapes, and, in this way, the hold of a foot in an inner shoe or a shoe generally can be improved significantly. In order to achieve this objective, the invention is comprised essentially of two plate-shaped parts or tabs which are connected at the exterior side of the sole on both sides of the longitudinal center plane of the shoe and overlap one another in the instep region while sliding along one another. By means of the flexible connection of the two mutually overlapping plate-shaped parts to the outer sole, it is first ensured that, when pressure is applied to these parts, a minimum width remains in the lateral areas of the foot without annoying pressure points. The main part of the pressure is exerted on the instep region. Therefore, a large measure of adaptability to various instep shapes is achieved since the two mutually overlapping parts, by sliding along one another, can adapt themselves more precisely to the shape of a foot than can one correspondingly stiff plate. In contrast to highly flexible straps, this type of construction makes it possible to provide a good distribution of pressure on the top side of the instep of a foot without generating lateral pressure points. The connection of the mutually overlapping plate-shaped parts to the sole may occur in a simple manner through webs which may form one piece with the material of the sole or may be welded or glued to it. In this way, large spaces in the lateral areas of the plate-shaped parts are kept free and, consequently, cannot become the source of lateral pressure points.

According to a preferred embodiment of the invention, the plate-shaped parts extend in the longitudinal direction of the shoe over a region that corresponds to at least half, and preferably two thirds, of the length of the instep. By means of this longitudinal course of the plate-shaped parts, a particularly even distribution of pressure along the instep region of the foot is ensured, as is the absence of annoying pressure points even in the event of higher contact pressure along the top side of the instep.

The system of this invention permits a particularly simple adjustment of the pressure that is required for securing a foot in the instep region without pressure points in which at least one of the plate-shaped parts interacts with an adjusting element located on the exterior side of the shoe. Such an adjusting element could be a buckle, a worm or a tightening element applied to tension elements that reach over the plate-shaped part. Due to the relative slidability of the mutually overlapping parts, better adaptability to different foot shape results, higher contact pressure can be applied without annoying pressure points, and the hold of the foot in the shoe is improved significantly. In contrast to known constructions in which instep plates are pressed against the instep by cable pulls, another advantage of this invention results in the uniform distribution of force over a larger length of the instep through the use of tension elements, particularly tightenable cords or bands which can reach at least partly over the plate-shaped parts. Since additional evening-out of applied pressure results from use of bands that reach at least partially over the plate-shaped parts, a softer material, on the whole, can be selected for the plate-shaped mutually overlapping parts.

A particularly uniform introduction of force into the plate-shaped mutually overlapping parts that slide along one another can be achieved by running the tension elements so that they cross one another and providing the possibility of displacing the tension elements in the longitudinal direction of the shoe at at least one such crossing point. This arrangement has the additional advantage not only of a particularly uniform introduction of force, but also of an introduction of force which can be shifted along the longitudinal axis of the ski boot. For this purpose, the crossing point may advantageously be guided within a lug that is coupled to a operable element moveable in the longitudinal direction of the shoe. An element of this type may, for example, be formed by a rack that can be shifted by a rotatable adjusting element located on the exterior side of the shoe and a pinion. The longitudinal adjustment may also take place by means of worm drives or longitudinally variable pressure cuffs or tension elements of a buckle.

In a preferred embodiment of the invention, when the tension elements are coupled and/or secured at the plate-shaped parts, by tightening the tension elements, a displacement of the plate-shaped parts relative to each other can be caused directly, and an improvement of the hold of the foot or the inner shoe in a shoe is achieved. Moreover, if the tension elements are arranged so that they cross one another, and the crossing point is further constructed so that it can be displaced in the longitudinal direction of the shoe, it becomes especially easy to adjust the extent to which the plate-shaped parts overlap each other. Under these circumstances, the application of additional pressure at the top side of the overlapping area seems particularly desirable, especially if the shape of the instep deviates significantly from the interior contour of the outer shell. In order to achieve this result, it is advantageous to place a vertically adjustable pressure element close to the crossing point or at the crossing point of the tension element. In this way, in the event of an adjustment of the crossing point along the longitudinal direction of the shoe, the deflecting point or the crossing point of the tension elements relative to the shell is maintained at a constant level, so that additional pressure from above can be exercised without affecting the tension forces of the tension elements.

A particularly uniform introduction of force is also obtained if the wall thickness of the plate-shaped parts decreases from the sole to the overlapping area. This type of construction, in which the lateral regions of the foot or, respectively, the inner shoe, are effected relatively little by a swivelling or displacement of the overlapping plate-shaped parts results in a good introduction of force in the actual instep region of the foot or, respectively, the inner shoe.

In the following, the invention is explained in closer detail by reference to an embodiment shown in the drawings.

Figure 2:
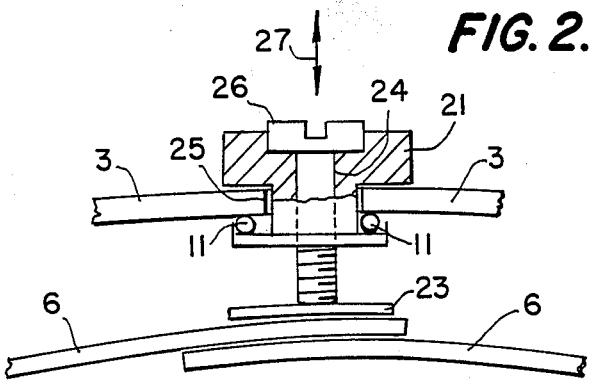

FIG. 1 is a lateral view of the system according to the invention as used in a ski boot, and FIG. 2 is a sectional view along Line II—II of FIG. 1.

FIG. 1 shows a ski boot 1 that has a tiltable rear part 2 as well as a shell 3 which reaches over the toe region and the instep region. In the interior of this ski boot 1, an inner shoe 4 is indicated in diagram form. Plate-shaped parts 6 are attached in the area of the sole of shell 3 and by means of webs 5 reach over the inner shoe or, respectively the foot, in the instep region, at which point, in addition, an instep plate 7 is provided. In order to promote good leg mobility relative to the sole 8, a cuff 9 is provided that is coupled to the shell 3 so that it can be swivelled around a swivel axis 10. The same swivel axis 10 can also be used for the swivelling of tiltable rear part 2. To close the shoe, tiltable rear part 2 is tightened against cuff 9 by means of a conventional tightening buckle using a strap.

In the interior of the shoe and, when an inner shoe is used, between the shell 3 and the inner shoe 4, a tension element 11 composed of cords is arranged which is led over a component 12 having deflecting points and which, in the rear region of the shoe, can be secured at an elastically deformable shell part 13 situated on a vertical plane with respect to sole 8. Tension element 11 may be secured at the swivelling or elastically deformable shell part 13 at three different points indicated by reference numeral 14.

When a clamping device 15 is secured at tiltable rear part 2, the tension element 11, originating at the swivelling or deformable shell part 13, initially extends down towards component 12 and is then deflected back in the direction of tiltable rear part 2, at which point, a pulley 16 is applied to tension element 11. Pulley 16 is connected to a clamping element 17 which, in turn, is led to clamping device 15 taking the form, for example, of a simple tightening buckle. The clamping element 17 penetrates the shell 3 or the tiltable rear part 2, and due to the arrangement of the deflecting points in component 12, an introduction of force is obtained through tension in clamping device 15 that engages both that part of tension element 11 that is directed to the swivelling or elastically deformable shell part 13, as well as that part of tension element 11 that is directed to instep plate 7.

Tension element 11 is led along the side of the instep region and then across both instep plate 7 and overlapping, plate-shaped parts 6 in a manner which allows a gripping force to be applied to both instep plate 7 and plate-shaped parts 6. For this purpose, for example, deflection points 18 may be located on the plate-shaped parts 6 in the instep region. The tension element ends 19 are secured on the plate-shaped parts 6. Due to the mutually crossing paths of the tension element or tension elements 11 in the area of the plate-shaped parts 6, the additional possibility is provided to displace such a crossing point in the instep region of the direction of double arrow 20. For this purpose, an adjusting element 21 is provided which interacts with a crossing point 22 of the tension elements 11 in the toe region. The crossing point 22 may, for example, be implemented in a lug which, by means of adjusting element 21, shown as a knurled nut, can be slid in the direction of the double arrow 20, for example, by a rack-and-pinion coupling.

FIG. 2 shows a vertically adjustable pressure element 23 for pressure distribution in the instep region that can be adjusted in a vertical direction. In a bore 24 in adjusting element 21 that penetrates shell 3 through an opening 25, a pin 26 is arranged that can be adjusted in a vertical direction and can be screwed in a simple manner. Through rotation of pin 26, pressure element 23 is displaced in the direction of double arrow 27 in a vertical direction. In this way an adjustment of the pressure exercised on the plate-shaped parts 6 is made possible. Pressure element 11 is suspended in an area between shell 3 and pressure element 23 on adjusting element 21.

I claim:

1. A system for securely and comfortably holding a foot in a boot, particularly in the toe and instep regions, comprising:

a shell covering at least the toe and instep regions;

a sole;

an inner shoe adapted to fit within said shell;

first and second plate-shaped parts, each connected to an opposite side of said sole along the longitudinal axis of said sole, extending over said inner shoe so as to overlap each other in the toe and instep regions without being attached to each other wherein said plate-shaped parts may move freely with respect to each other in the overlapping regions; and tension element means for adjusting the position of said plate-shaped parts with respect to said shell and to said instep and toe regions of the foot and for distributing pressure on said plate-shaped parts.

2. The system of claim 1, wherein said first and second plate-shaped parts are each connected to said sole along an area that extends along between one-half and two-thirds of the instep region.

3. The system of claim 2, wherein said first and second plate-shaped parts are each connected to said sole by web means for reducing confinement of lateral areas of the foot and for minimizing the occurrence of pressure points in such lateral areas.

4. The system of claim 1, wherein said first and second plate-shaped parts are each connected to said sole by web means for reducing confinement of lateral areas of the foot and for minimizing the occurrence of pressure points in such lateral areas.

5. The system of claim 1, further comprising adjusting element means located on the exterior of the boot for adjusting said tension element means, wherein at least one said plate-shaped part is cooperatively joined with said adjusting element means.

6. The system of claim 3, further comprising adjusting element means located on the exterior of the boot for adjusting said tension element means, wherein at least one said plate-shaped part is cooperatively joined with said adjusting element means.

7. The system of claim 6, wherein said tension element means reach at least partially over said plate-shaped parts.

8. The system of claim 1, wherein said tension element means traverse itself, further comprising at least one crossing point at which said tension element means may be displaced along the longitudinal axis of the boot.

9. The system of claim 7, wherein said tension element means traverse itself, further comprising at least one crossing point at which said tension element means may be displaced along the longitudinal axis of the boot.

10. The system of claim 1, wherein said tension element means is cooperatively joined with said plate-shaped parts.

11. The system of claim 7, wherein said tension element means is cooperatively joined with said plate-shaped parts.

12. The system of claim 9 further comprising vertically adjustable pressure element means for varying vertical pressure exerted on said plate-shaped parts.

13. The system of claim 1 wherein each of said first and second plate-shaped parts have walls which decrease in thickness from the end thereof which is connected to said sole to the opposing end thereof.

14. The system of claim 12 wherein each of said first and second plate-shaped parts have walls which decrease in thickness from the end thereof which is connected to said sole to the opposing end thereof.

15. A system for securely and comfortably holding a foot in a shoe, particularly in the toe and instep regions, comprising:

a shell covering at least the toe and instep regions;

a sole;

first and second plate-shaped parts, each connected to an opposite side of said sole along the longitudinal axis of said sole, wherein said plate-shaped parts overlap each other in the toe and instep regions without being attached to each other and wherein said plate-shaped parts may move freely with respect to each other in the overlapping regions; and tension element means for adjusting the position of said plate-shaped parts with respect to said shell and to said instep and toe regions of the foot and for distributing pressure on said plate-shaped parts.

16. The system of claim 15, wherein said first and second plate-shaped parts are each connected to said sole along an area that extends along between one-half and two-thirds of the instep regions.

17. The system of claim 16, wherein said first and second plate-shaped parts are each connected to said sole by web means for reducing confinement of lateral areas of the foot and for minimizing the occurrence of pressure points in such lateral areas.

18. The system of claim 16 wherein each of said first and second plate-shaped parts have walls which decrease in thickness from the end thereof which is connected to said sole to the opposing end thereof.

19. A system for securely and comfortably holding a foot in a boot, particularly in the toe and instep regions, comprising:

a shell covering at least the toe and instep regions;

a sole;

an inner shoe adapted to fit within said shell;

first and second plate-shaped parts, each connected to an opposite side of said sole along an area that extends along between one-half and two-thirds of the length of the instep by web means for minimizing lateral pressure against the foot along the longitudinal axis of said sole, said plate-shaped parts extending over said inner shoe so as to overlap each other in the toe and instep regions without being attached to each other wherein said plate-shaped parts may move freely with respect to each other in the overlapping regions;

tension element means for adjusting the position of said plate-shaped parts with respect to said shell and to said instep and toe regions of the foot and for distributing pressure on said plate-shaped parts wherein said tension element means reaches at least partially over said plate-shaped parts and is cooperatively joined with said plate-shaped parts;

adjusting element means for adjusting said tension element means wherein at least one of said plate-shaped parts is cooperatively joined with said adjusting element means;

a crossing point at which said tension element means may be displaced along the longitudinal axis of the boot; and vertically adjustable pressure element means for varying vertical pressure exerted on said plate-shaped parts.

* * * * *